US010823493B2

(12) United States Patent
Lindel et al.

(10) Patent No.: US 10,823,493 B2
(45) Date of Patent: Nov. 3, 2020

(54) HOUSEHOLD APPLIANCE WITH AN ALIGNMENT CONTOUR PROVIDED ON A WALL ELEMENT

(71) Applicant: BSH-HAUSGERAETE GMBH, Munich (DE)

(72) Inventors: Andreas Lindel, Heidenheim (DE); Ralf Spiller, Giengen (DE); Roland Kuemmel, Nellingen (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 16/298,254

(22) Filed: Mar. 11, 2019

(65) Prior Publication Data

US 2019/0301790 A1 Oct. 3, 2019

(30) Foreign Application Priority Data

Mar. 28, 2018 (DE) ..... 10 2018 204 780

(51) Int. Cl.

*A47B 96/04* (2006.01)
*F25D 25/02* (2006.01)
*F25D 23/06* (2006.01)

(52) U.S. Cl.

CPC ..... *F25D 25/025* (2013.01); *F25D 23/066* (2013.01); *F25D 23/067* (2013.01); *F25D 25/024* (2013.01); *E05Y 2900/31* (2013.01); *F25D 2500/02* (2013.01)

(58) Field of Classification Search

CPC ..... A47B 88/43; F25D 25/024; F25D 25/025; F25D 23/066; F25D 23/067

USPC ..... 312/402

See application file for complete search history.

(56) References Cited

U.S. PATENT DOCUMENTS

2002/0037199 A1* 3/2002 Satran ..... B23C 5/1045 407/54
2004/0025969 A1* 2/2004 Lindsay ..... B23C 5/207 144/241
2005/0127683 A1* 6/2005 Nam ..... E05O 19/024 292/96
2006/0218958 A1* 10/2006 Rand ..... F25D 11/022 62/302
2007/0085457 A1* 4/2007 Park ..... F25D 25/025 312/402

(Continued)

FOREIGN PATENT DOCUMENTS

CN 102109265 A * 6/2011 ..... F25D 25/024
KR 20100080971 A 7/2010

(Continued)

OTHER PUBLICATIONS

English Translation of Bai (CN102109265) (Year: 2020).*

*Primary Examiner* — Matthew W Ing

(74) *Attorney, Agent, or Firm* — Laurence A. Greenberg; Werner H. Stemer; Ralph E. Locher

(57) ABSTRACT

A household appliance includes a body and a receiving chamber located in the body and at least partially delimited by a wall element. A holding part is disposed on a face of the wall element facing away from the receiving chamber, is coupled to an alignment contour provided on the wall element and extends over the alignment contour in a plane encompassing the wall element. The alignment contour has a projection facing away from the receiving chamber and being elongated in the plane encompassing the wall element.

20 Claims, 8 Drawing Sheets

(56) References Cited

U.S. PATENT DOCUMENTS

| | | | | |
|---|---|---|---|---|
| 2008/0115526 | A1 | 5/2008 | Oh et al. | |
| 2009/0079312 | A1* | 3/2009 | Laible | F25D 25/025 312/334.27 |
| 2010/0090574 | A1* | 4/2010 | Lim | F25D 25/025 312/404 |

FOREIGN PATENT DOCUMENTS

| | | | |
|---|---|---|---|
| KR | 20140144445 | A | 12/2014 |
| WO | 2011080654 | A2 | 7/2011 |

* cited by examiner

HOUSEHOLD APPLIANCE WITH AN ALIGNMENT CONTOUR PROVIDED ON A WALL ELEMENT

CROSS-REFERENCE TO RELATED APPLICATION

This application claims the priority, under 35 U.S.C. § 119, of German Patent Application DE 10 2018 204 780.4, filed Mar. 28, 2018; the prior application is herewith incorporated by reference in its entirety.

BACKGROUND OF THE INVENTION

Field of the Invention

The invention relates to a household appliance including a body, a receiving chamber which is located in the body and at least partially delimited by a wall element, and a holding part which is disposed on a face of the wall element facing away from the receiving chamber, is coupled to an alignment contour provided on the wall element and extends over the alignment contour in a plane encompassing the wall element.

Such a household appliance can, for example, be a refrigeration appliance, a cooking appliance or a dishwasher. If the household appliance is a refrigeration appliance, it can be a refrigerator, a freezer or combined refrigerator/freezer appliance.

In such household appliances built-in parts located within the receiving chamber are often fastened to the holding part located outside the receiving chamber. The holding part allows the built-in part to be fastened more securely.

A refrigeration appliance with an outer housing and an inner container is known from International Publication WO 2011/080654 A2, in which a reinforcement element is fastened to the inner container between the outer housing and the inner container and a support element disposed within the inner container is fastened to the reinforcement element.

SUMMARY OF THE INVENTION

It is accordingly an object of the invention to provide a household appliance with an alignment contour provided on a wall element, which overcomes the hereinafore-mentioned disadvantages of the heretofore-known appliances of this general type.

With the foregoing and other objects in view there is provided, in accordance with the invention, a household appliance comprising a body, a receiving chamber located in the body and at least partially delimited by a wall element, and a holding part which is disposed on a face of the wall element facing away from the receiving chamber, is coupled to an alignment contour disposed on the wall element and extends over the alignment contour in a plane encompassing the wall element, the alignment contour having a projection facing away from the receiving chamber and being elongated in the plane encompassing the wall element.

Since the projection is constructed to be "elongated," it has at least one longitudinal extension which is greater than its other extensions (for example a width extension and a height extension).

Since the projection faces away from the receiving chamber, it is possible to configure the alignment contour in such a way that it does not restrict the receiving chamber spatially. In particular, the available volume of the receiving chamber is not reduced and the accessibility of the receiving chamber is not impaired, for example for introducing shelves, pull-out apparatuses, storage trays, etc.

The present invention is based on the knowledge that the elongated configuration of the projection reliably allows precise positioning of the holding part. The coupling of the holding part to the alignment contour and, in particular, the projection allows the desired end position of the holding part to be reached by using a simple mounting step. The resulting precise positioning of the holding part in turn allows a built-in part which is to be fastened to the holding part to be disposed precisely in the receiving chamber with respect to position and above all alignment.

The elongated configuration of the projection also allows better support for the holding part. Weight forces acting on the holding part, in particular, can be reliably absorbed. A built-in part to be received in the receiving chamber and fastened to the holding part, for example a pull-out configuration, can be held securely and reliably as a result.

The expression that the wall element "at least partially" delimits the receiving chamber means, in particular, that the receiving chamber can also be delimited by further wall elements. For example, the wall element of the invention can be a side wall and the receiving chamber can also be delimited by a base, a top and a rear wall.

The receiving chamber is typically disposed in a body of the household appliance and can be closed or made accessible by a closure element, for example a door, drawer or flap. The body typically has an outer wall. A hollow space filled with thermally insulating material can be formed between the wall element of the invention (and the possible further wall elements delimiting the receiving chamber) and the outer wall.

It is possible, in principle, for the alignment contour to include one or more further elements in addition to the projection. It is conceivable, for example, for the alignment contour to also have a projection facing the receiving chamber. According to one embodiment, however, provision is made for the alignment contour to be formed by the projection, which faces away from the receiving chamber and is configured to be elongated in a plane encompassing the wall element. The alignment contour is then finally formed by the projection, i.e. it includes no further elements.

It is possible, in principle, for the projection to be constructed to be solid. The projection is then a massing of the material of the wall element. However, for simple and economical manufacture, according to one embodiment, provision is made for the projection to form a recess facing the receiving chamber. Provision is preferably made for the size and/or shape, in particular the spatial orientation, of the recess to correspond substantially to that of the projection. Provision can be made, in particular, for the projection to substantially have a constant wall thickness, in particular a wall thickness corresponding substantially to the wall thickness of the wall element.

The alignment contour can be formed by a component configured separately from the wall element. A "separately configured component" in this case and in the following means that the respective elements or components, in this instance the alignment contour and the wall element, are formed by separately produced components, which may be connected to one another with a form-locking, force-locking and/or material joint. According to one embodiment, however, provision is made for the alignment contour to be configured as a single piece with the wall element. "Configured as a single piece" in this case and in the following means that the two elements or components (in this instance alignment contour and wall element) are produced in an integral manner, in particular from one material, in one manufacturing step. In particular, the alignment contour can be formed as the wall element is produced or shaped. It is conceivable for the wall element, including the alignment contour, to be produced by thermoforming and/or from plastic.

According to one embodiment, provision is made for a longitudinal extension of the projection to be disposed horizontally. This allows bearing surfaces formed on the projection and disposed horizontally and interacting with support surfaces of the holding part to have a maximum extension. Support for weight forces acting on the holding part can thus be optimized.

The alignment contour can be configured in rib form. In particular, the alignment contour can be formed completely by a rib. It is, however, also conceivable for the alignment contour to also have further elements if required. According to one embodiment provision is made for the alignment contour to have at least one rib-like segment. The rib-like segment is configured to be elongated, in particular, and has a longitudinal extension, which runs parallel to the longitudinal extension of the alignment contour. It is conceivable for the longitudinal extension of the rib-like segment to form at least 50%, at least 70% or at least 80% of the longitudinal extension of the alignment contour. The rib-like segment can have a constant cross section along its longitudinal extension.

According to one embodiment provision, is made for enlargement segments to be formed on end segments of the rib-like segment. The enlargement segments are part of the alignment contour.

According to one embodiment, provision is made for a height of the enlargement segment measured from a surface of the wall element facing away from the receiving chamber to be greater than a correspondingly measured height of the rib-like segment. The projection therefore extends further from the receiving chamber in the region of the enlargement segment. According to one embodiment, provision is made for a width of the enlargement segment measured perpendicular to the longitudinal extension of the alignment contour to be greater than a correspondingly measured width of the rib-like segment. Such configurations of the enlargement segment also allow for better positioning of the holding part on the alignment contour.

The holding part can be made up of two or more separately configured components. According to one embodiment, however, provision is made for the holding part to be configured as a single piece. The holding part can be formed by a metal part, in particular a punched and bent part. The holding part can be configured with thin walls. It is conceivable, in particular, for the holding part to have a substantially constant wall thickness.

According to one embodiment, provision is made for the holding part to be elongated. The longitudinal extension of the holding part preferably corresponds to at least twice the value, at least 4 times the value or at least 5 times the value of the other extensions of the holding part. The holding part can be formed by a rail. The longitudinal extension of the holding part can be greater than the longitudinal extension of the alignment contour. In particular, the longitudinal extension of the holding part can be at least 1.5 times, 2 times or 3 times the longitudinal extension of the alignment contour. The holding part can cover the alignment contour on both sides in a direction running in the longitudinal extension of the alignment contour. The holding part can cover the alignment contour on both sides in a direction running perpendicular to the longitudinal extension of the alignment contour. The holding part and the alignment contour can run parallel with respect to their longitudinal extensions.

According to one embodiment, provision is made for the holding part to have a coupling segment, through the use of which the holding part is coupled to the alignment contour with a form-locking and/or force-locking connection. It is possible for forces (in particular weight forces) acting on the holding part to be dissipated exclusively, substantially exclusively or at least partially to the wall element by way of the coupling segment.

According to one embodiment, provision is made for the coupling segment to have at least one bridge element and/or at least one aperture. The bridge element can be configured to be elongated, in particular. An aperture can, in particular, adjoin an end segment of the bridge element. The shape of the bridge element can be configured to complement the projection or at least a sub-segment of the projection. In particular, the bridge element can be configured to complement the rib-like segment.

According to one embodiment, provision is made for the holding part to be configured to be elongated and for the coupling segment only to extend over a sub-segment of a longitudinal extension of the holding part. The coupling segment can be disposed centrally with respect to the longitudinal extension of the holding part, thereby simplifying mounting of the holding part on the alignment contour. However, in order to position elements of the holding part (for example fastening segments for a component) disposed, in particular, asymmetrically with respect to the longitudinal extension reliably and without error, provision can be made for the coupling segment to be disposed non-centrally with respect to the longitudinal extension of the holding part. The non-central configuration of the coupling segment also allows positions for possible fastening segments on the holding part to be more freely selected.

According to one embodiment, provision is made for the holding part to be configured to be elongated and to have at least two fastening segments at a distance from one another along its longitudinal extension, to which a built-in part disposed in the receiving chamber is fastened. The built-in part can be fastened to the at least two fastening segments by using two adapter parts. In particular, however, provision can be made for the built-in part to be configured as a single piece and be fastened directly to the at least two fastening segments. The at least two fastening segments can be formed by a projection of the holding part. In particular, the two fastening segments can be configured in a domed manner. The two fastening segments can be formed by an embossed structure. This increases the mechanical stability of the fastening segments. The fastening segments can each have a screw hole so that the built-in part can be fastened by using a screw. The screw hole can be formed, in particular, in a cylindrical attachment so that a sufficient number of turns can be achieved despite the thin wall thickness of the holding part.

The fastening segments can be configured separately from the coupling element to allow an optimum position for fastening the built-in part. In particular, an overlap-free configuration of the coupling element and the fastening segment is conceivable (when the holding part is projected onto a plane encompassing the wall element). According to one embodiment, provision is made for the coupling segment to be disposed between the at least two fastening segments with respect to the longitudinal extension of the holding part.

According to one embodiment, provision is made for the wall element to have at least two apertures and for each fastening segment to be accessible from the receiving chamber through an aperture. Provision is preferably made for the apertures to be configured separately from one another and to be disposed at a distance from one another, in particular for each aperture to be configured with closed edges. The apertures can be configured separately from the alignment contour and disposed at a distance therefrom. If a fastening segment is formed by a projection, provision can be made for the fastening segment to engage at least partially in the aperture. The fastening segment can therefore be positioned nearer to the receiving chamber, thereby simplifying the mounting of a built-in part. Provision can be made, in particular, for a surface of the fastening segment facing the receiving chamber to be configured to be flat and/or at least partially or completely flush with a surface of the wall element enclosing or framing the aperture. Provision can be made, in particular, for the fastening segment not to project into the receiving chamber beyond a surface of the wall element enclosing the aperture and facing the receiving chamber. The holding part can preferably be disposed completely outside the receiving chamber.

According to one embodiment, provision is made for the holding part to be configured to be elongated and to be disposed horizontally and for a built-in part disposed in the receiving chamber and fastened to the holding part to be part of a pull-out apparatus or to be such. The invention therefore allows both extremely precise alignment of the pull-out apparatus and also secure fastening of the pull-out apparatus. In particular, if a closure element (for example a drawer front) of the receiving chamber is disposed on the pull-out apparatus and can also be seen by a user in the closed state, the invention allows a high-quality external appearance to be achieved in a simple manner, since any possible spaces between the drawer front and further closure elements have the desired dimensions in a reliable and precise manner.

According to one embodiment, provision is made for the projection to be configured to be closed or to have a closed base. Provision can be made, in particular, for the projection not to have any apertures. It is, however, also conceivable for the projection to have one, two or more apertures. This allows an additional connection between the wall element and the holding part and/or the holding part and an additional fixing element.

According to one embodiment, provision is made for the holding part and the wall element to be screwed to one another, preferably in the region of the alignment contour.

The advantages of the invention can be achieved simply by coupling the holding part to the alignment contour. In order to further improve the positioning of the holding part and also the transfer of weight forces acting on the holding part, however, provision can be made according to one embodiment for the alignment contour to have a recess facing the receiving chamber, in which a fixing element is located, which is coupled to the holding part. One, two or more apertures can be formed in the projection for the coupling between the fixing element and the holding part. The coupling can be brought about with a form-locking and/or a force-locking and/or a material joint. For example, the fixing element can be latched to the holding part. In order to ensure secure and resilient coupling, the fixing element can be screwed to the holding part.

The fixing element can be configured as a single piece. The fixing element can be made of metal or plastic. In particular, the fixing element can be an injection molded plastic part.

The fixing element can fill the recess completely, partially or substantially completely. In particular, provision can be made for a surface of the fixing element facing the receiving chamber to terminate flush with a surface of the wall element enclosing or framing the recess or to be set back from the surface. This means that the fixing element does not interfere with built-in parts to be disposed in the receiving chamber.

The fixing element can be supported on a bearing surface of the recess by using a support surface. This allows forces (in particular weight forces in the case of a horizontal configuration of the bearing surface and the support surface) acting on the holding part to also be transferred to the wall element by way of the fixing element.

According to one embodiment, the household appliance also has a bonding device, which is in contact with the holding part and the wall element. The bonding device can therefore assist with fastening the holding part to the wall element. However, the bonding device is preferably not configured to absorb weight forces acting on the holding part when the household appliance is used in the intended manner. Rather the bonding device can be configured to allow preliminary fixing of the holding part until it is adequately fixed, for example by insulating material, which is disposed on the surface of the wall element facing away from the receiving chamber. The bonding device can be adhesive tape or hot glue. The bonding device can also form a seal between the holding part and the wall element and/or a seal for apertures in the wall element.

According to one embodiment, provision is made for the household appliance to have at least one further wall element, which at least partially delimits the receiving chamber, and for the household appliance to have at least one further holding part, which is disposed on a face of the further wall element facing away from the receiving chamber and which is coupled to a further alignment contour configured on the further wall element. Provision is preferably made in this case for the further alignment contour to have a further projection that faces away from the receiving chamber and is configured to be elongated in a plane encompassing the further wall element. All of the features and properties described for the wall element, the alignment contour and the projection can also be applied in this case to the further wall element, the further alignment contour and the further projection. Provision can be made, in particular, for the wall element and the further wall element to form opposing wall elements with respect to the receiving chamber (for example left side wall and right side wall).

The household appliance can be a refrigeration appliance, a cooking appliance or a dishwasher. If the household appliance is a refrigeration appliance, it can be a refrigerator, a freezer or a combined refrigerator/freezer appliance. In the case of a refrigeration appliance, the receiving chamber is formed by a refrigeration chamber and the wall element can be part of an inner container, which is made, in particular, of plastic.

The terms "top," "bottom," "front," "rear," "horizontal," "vertical," "depth direction," "width direction," "height direction," etc. are the positions and orientations as they appear to an observer standing in front of a household appliance and looking in the direction of the household appliance, when the household appliance is used and disposed in the intended manner.

Other features which are considered as characteristic for the invention are set forth in the appended claims.

Although the invention is illustrated and described herein as embodied in a household appliance with an alignment contour provided on a wall element, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
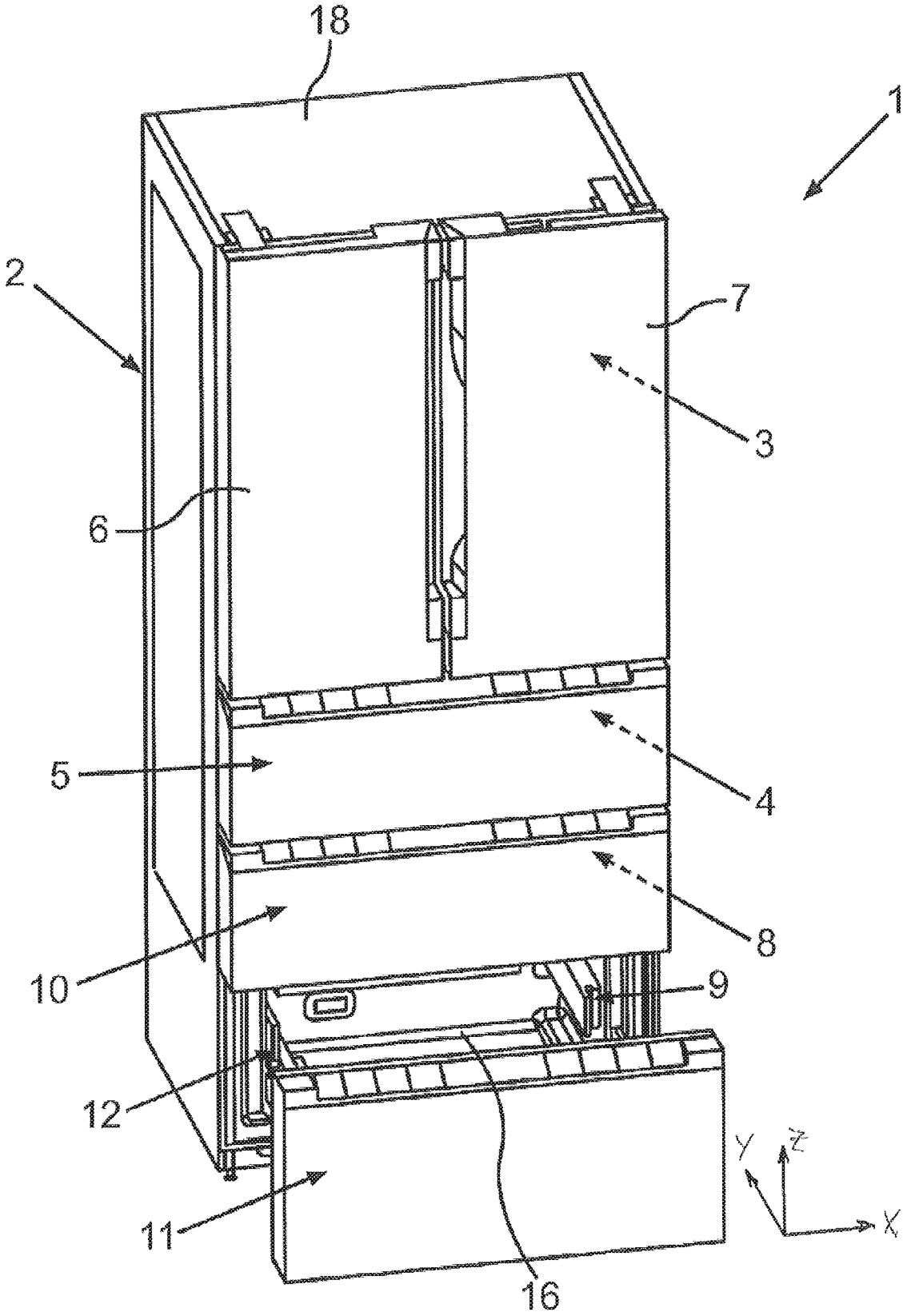
FIG. 1 is a diagrammatic, perspective view of a household appliance according to the invention.

Referring now in detail to the figures of the drawings, in which identical elements or those of identical function are shown with the same reference characters, and first, particularly, to FIG. 1 thereof, there is seen a household appliance 1, in the form of a household refrigeration appliance, configured to store and preserve food. In the exemplary embodiment the household appliance 1 is a combined refrigerator/freezer appliance. The household appliance 1 has a body 2, in which a number of separate receiving chambers for food are configured. A first receiving chamber 3 is provided in this case and configured in the present exemplary embodiment as a refrigeration compartment. The household appliance 1 also includes a keep-fresh compartment 4 configured below the refrigeration compartment in the height direction (Z direction) and representing a sub-volume of the refrigeration chamber 3, in which an air humidity and/or temperature can be set which is different from the remaining sub-volume of the receiving chamber 3 above it.

Provision is made in the exemplary embodiment for the receiving chamber 3 to be able to be closed by a number of separate doors disposed at the front. The keep-fresh compartment 4 in this case can be closed by a door 5, which is a front wall of a drawer that can be moved linearly in the depth direction (Y direction). The remaining sub-volume of the receiving chamber 3 can be closed by two further separate doors 6 and 7, which can be pivoted separately and independently of one another about vertical axes and therefore axes oriented in the height direction. This configuration allows the remaining sub-volume of the receiving chamber 3, which is not formed by the keep-fresh compartment 4, to be opened and closed independently of the keep-fresh compartment 4, by pivoting the doors 6 and/or 7 correspondingly. The keep-fresh compartment 4 in turn can be opened independently, by opening the door 5 and thus pulling out the drawer.

The household appliance 1 also includes two further separate receiving chambers 8 and 9, which are freezer compartments.

The two freezer compartments can also be closed in turn by separate doors 10 and 11. The doors 10 and 11 are also front walls of drawers that can be moved linearly in the depth direction in the exemplary embodiment shown herein. It is therefore shown by way of example that the lower freezer compartment can be closed by the front wall of a drawer 12 which is configured as the door 11, with the drawer 12 being shown in the pulled-out state in this case.

Figure 2:
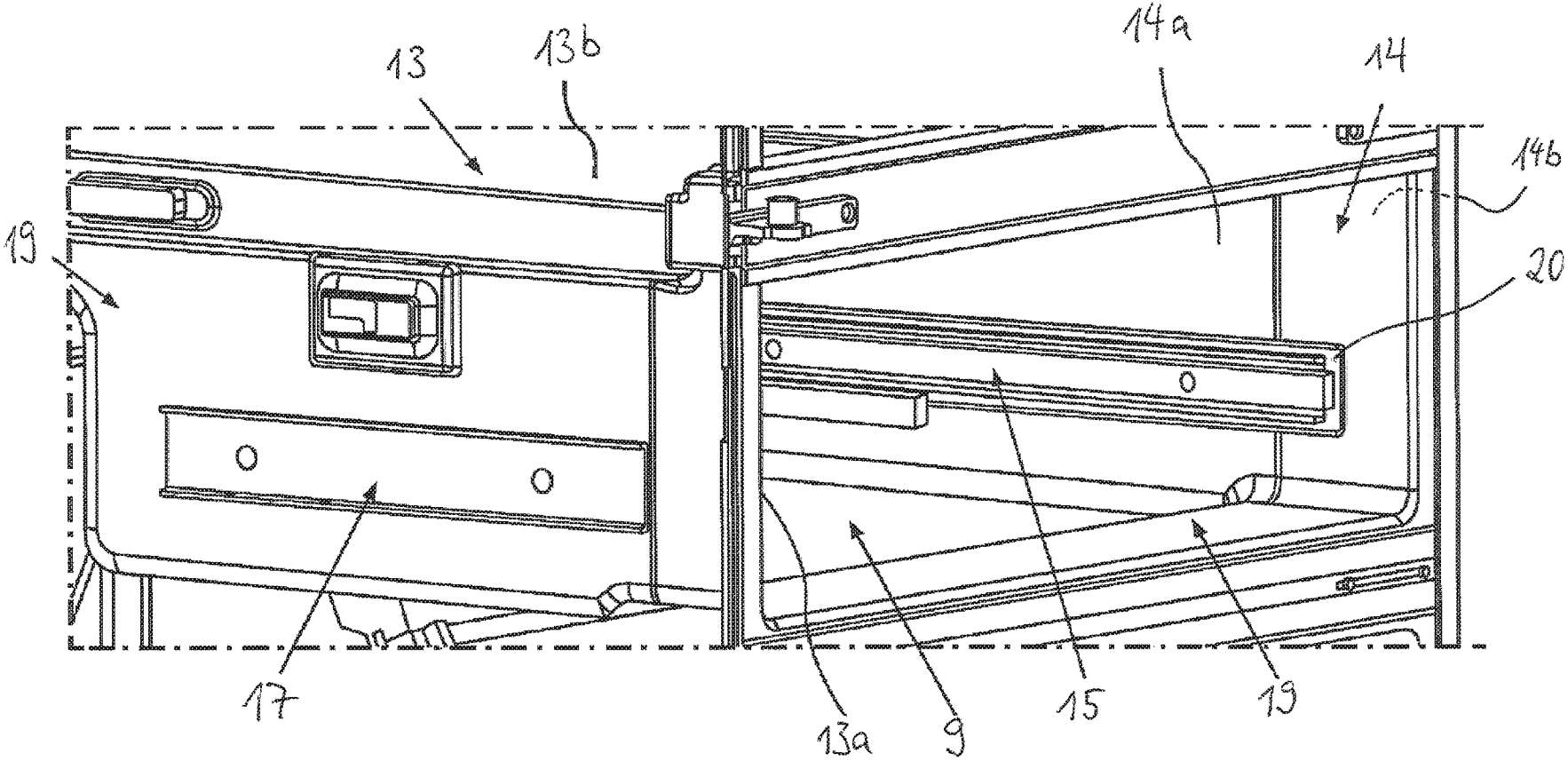
FIG. 2 is a fragmentary, perspective view of the household appliance according to FIG. 1.

The receiving chambers 3, 8 and 9 are delimited by an inner container, which is made in particular of plastic, the inner container having side walls or wall elements 13 and 14 oriented in the height direction as shown in the view in FIG. 2, which shows a sub-region of the household appliance 1 in the region of the lower freezer compartment. In the view in FIG. 2 the drawer 12 is pulled out, so it is possible to look into the interior of the freezer compartment formed by the receiving chamber 9. It can be seen that a pull-out apparatus 15, which is telescopic, is disposed on an inner face 14*a* of the wall element 14, which at least partially delimits the receiving chamber in the form of the side wall. A corresponding pull-out apparatus, which is not shown in FIG. 2, is disposed on the opposing wall element 13, which also at least partially delimits the receiving chamber in the form of the side wall. The drawer 12 is disposed on these pull-out apparatuses 15, which are oriented in the depth direction, and can be moved by using the rail-type pull-out apparatuses 15.

As is also shown in FIG. 1, the drawer 12 has a container 16, which is configured to receive food, in addition to the front wall, which forms the door 11.

A built-in part 20, in particular in the form of the pull-out apparatus 15, is fastened by a separate holding part (not shown in FIG. 2) made of metal to the wall element 14. This part is therefore also provided in the pull-out apparatus, which is fastened to the wall element 13. It can also be seen in FIG. 2 that a rail-type holding part 17 is disposed on an outer face 13*b*, opposite an inner face 13*a*, of the wall element 13. This outer face 13*b* faces away from the receiving chamber 9 and faces an outer wall 18 (FIG. 1), which is a further part of the body 2. A space, into which thermally insulating material, in particular insulating foam, is introduced, is provided between the outer wall 18 and the inner container 19, as shown in FIG. 2.

Figure 3:
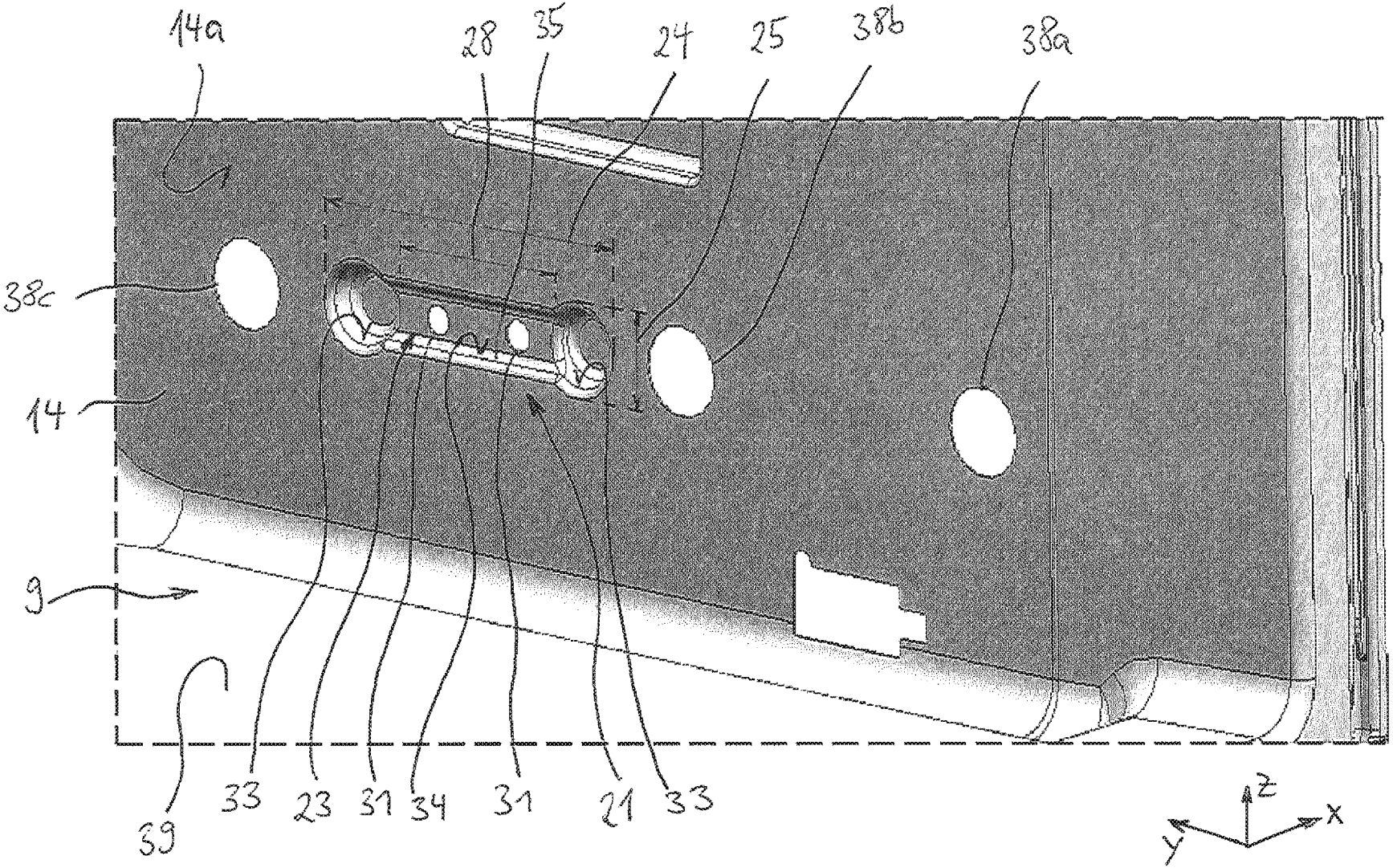
FIG. 3 is a fragmentary, perspective view of an inner container of the household appliance of FIG. 1 as viewed from a receiving chamber.
Figure 4:
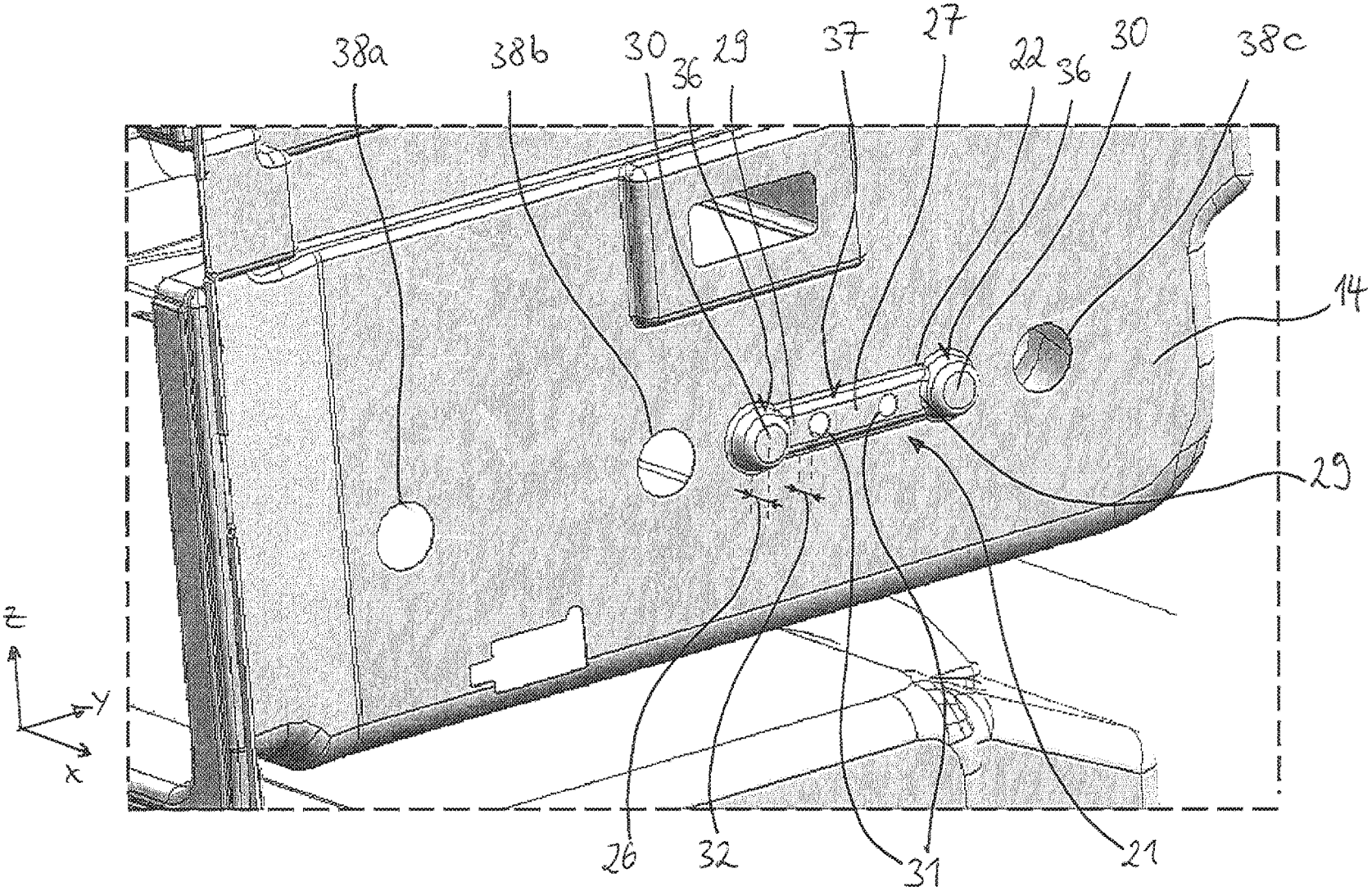
FIG. 4 is a fragmentary, perspective view of the inner container of FIG. 3 as viewed from its rear.

FIGS. 3 and 4 show a partial detail of the inner container 19. They show an alignment contour 21, which is configured as a single piece with the inner container 19 and therefore also with the wall element 14. The alignment contour 21 is formed by a projection 22 by thermoforming when the inner container 19 is produced. The alignment contour 21 therefore substantially has a constant wall thickness over the entire projection 22. The wall thickness corresponds substantially to the wall thickness of the wall element 14 away from the alignment contour 21. The projection 22 extends from the receiving chamber 9 in the width direction X. In particular, the projection 22 is configured on the face 14*b* of the wall element 14 facing away from the receiving chamber 9. A recess 23 configured to complement the shape and size of the projection 22 is configured on the inner face 14*a* of the wall element 14 facing the receiving chamber 9.

The projection 22 is configured to be elongated. In particular, a longitudinal extension 24 is greater than a widthwise extension 25 and greater than a height extension 26. The projection 22 is positioned in such a way that its longitudinal extension 24 extends parallel to the depth direction Y.

The projection 22 has a rib-like segment 27, which has a longitudinal extension 28 that is approximately 75% of the longitudinal extension 24 of the entire projection 22. Enlargement segments 30 are formed on end segments 29 of the rib-like segment 27. The enlargement segments 30 extend beyond the rib-like segment 27 in both the width direction X and the height direction Z. Therefore, the segments of the recess 23 formed by the enlargement segments 30 are deeper and wider than the segment of the recess 23 formed by the rib-like segment 27. In particular both enlargement segments 30 have a greater height extension (corresponding to the height extension 26 of the entire projection) than the height extension 32 of the rib-like segment 27.

The alignment contour 21 has two apertures 31 configured within the recess 23. The apertures 31 are both disposed completely within the rib-like segment 27.

The recess 23 has bearing surfaces 33, 34. The bearing surfaces 33 are formed by boundary walls of the segment of the recess 23 formed by the complementary shape of the enlargement segment 30. The bearing surface 34 is formed by a side boundary wall 35 of the segment of the recess 33 formed by the rib-like segment 27. The side boundary wall 35 and therefore the bearing surface 34 is configured to be substantially horizontal. The size of the bearing surface 34 is greater than the sum of the surfaces of the bearing surfaces 33. The projection 22 has bearing surfaces 36, 37.

The wall element 14 also has three apertures 38*a*, 38*b*, 38*c*. The alignment contour 21 is disposed between two adjacent apertures 38*b*, 38*c* in the depth direction Y. In particular, the alignment contour 21 is configured so that it does not overlap with the apertures 38*a*, 38*b*, 38*c*. The apertures 38*a*, 38*b*, 38*c* and the alignment contour 21 are disposed substantially in one height plane in the height direction Z.

The apertures 38*a*, 38*b*, 38*c* are also disposed in the wall element 14, in other words in the side wall. The wall element 14 transitions as a single piece into a further wall element 39, which forms a base of the receiving chamber 9.

Figure 5:
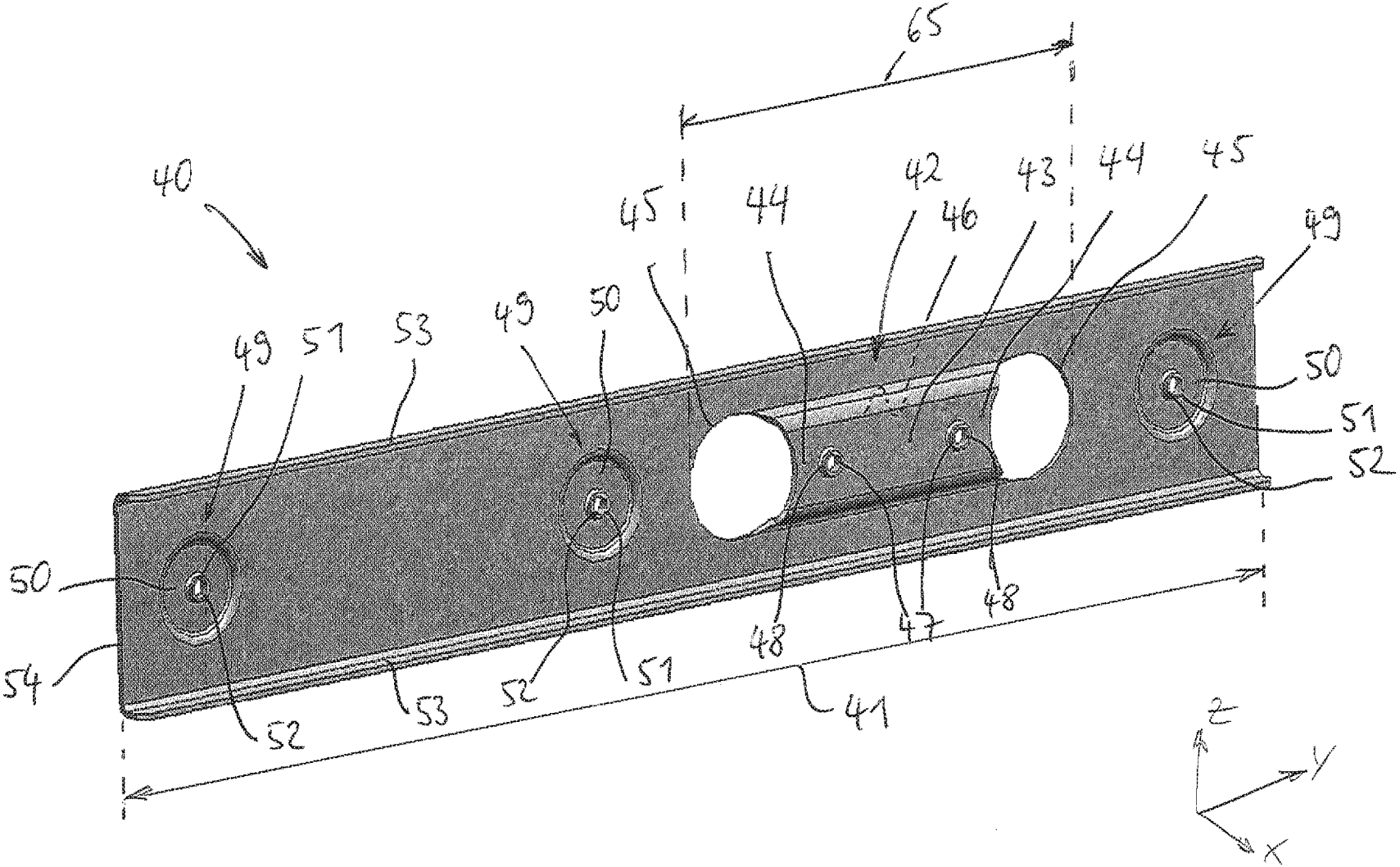
FIG. 5 is a perspective view of a holding part.

FIG. 5 shows a holding part 40 disposed on the wall element 14. The holding part 40, which is a single piece made of metal, has a coupling region 42 disposed non-centrally relative to its longitudinal extension 41. The coupling segment 42 only extends over a sub-segment 65 of the longitudinal extension 42.

The coupling segment 42 includes a bridge element 43 and two apertures 45 disposed on its end segments 44. Provided on the bridge element 43 is a support surface 46 which, when the holding part 40 is in the mounted state, is in contact with the bearing surface 37, to transfer weight forces acting on the holding part 40. The bridge element 43 also includes screw holes 47, which are configured in a cylindrical indentation 48.

The holding part 40 also includes three fastening segments 49, which are formed substantially by projections 50. The projections 50 extend counter to the width direction X, in other words in the direction of the receiving chamber 9 (see also FIG. 7). The projections 50 are configured with rotational symmetry and each have a centrally disposed screw hole 51, which is configured in a cylindrical indentation 52.

The holding part 40 also has two ribs 53, which are provided over the entire longitudinal extension 41 and project from a base plate 54 in the width direction X.

Figure 6:
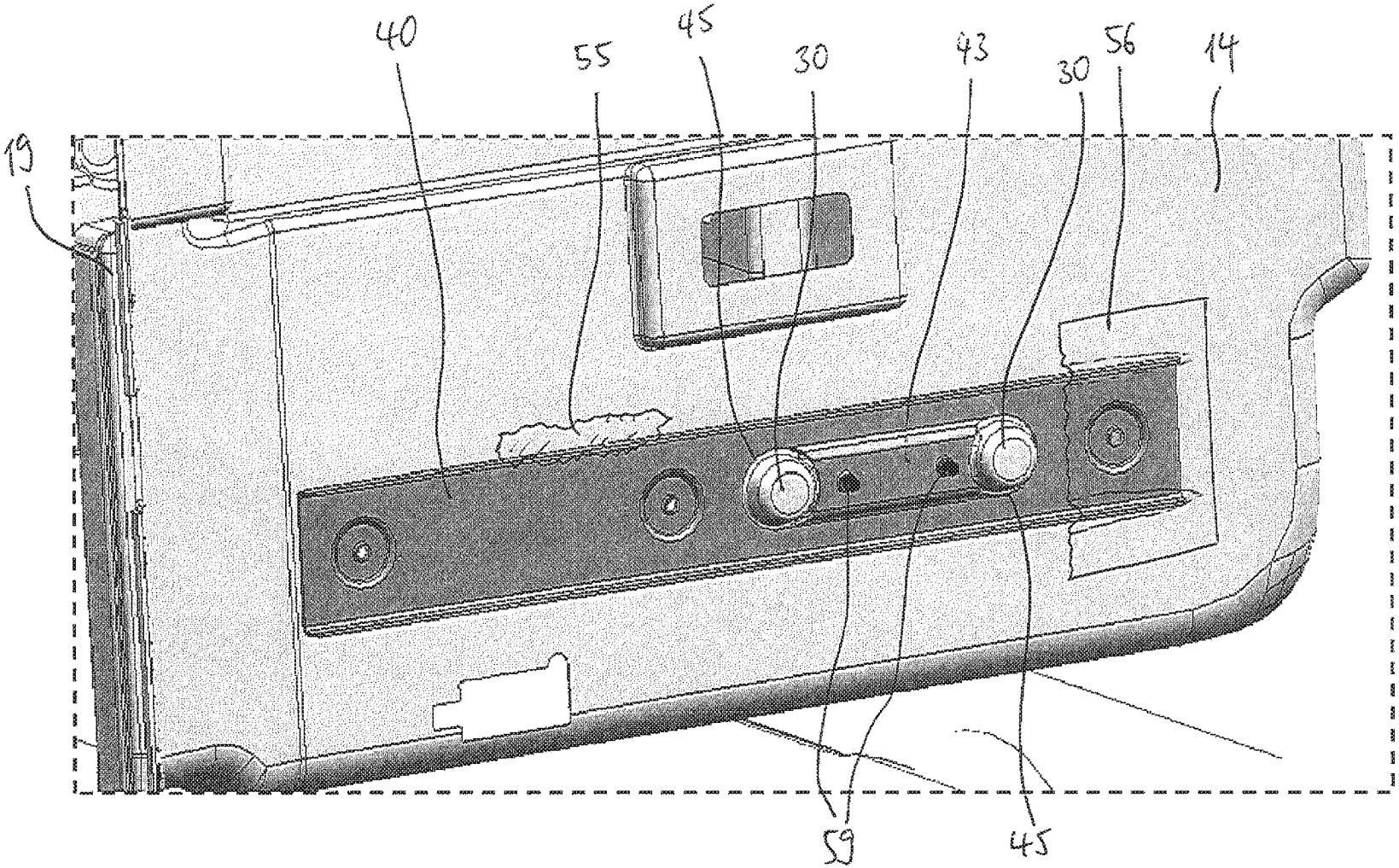
FIG. 6 is a fragmentary, perspective view as in FIG. 4 with the holding part mounted.

FIG. 6 shows the holding part 40 mounted on the inner container 19, in particular on the wall element 14. It also shows the bridge element 43 engaging in a form-locking manner over the rib-like segment 27. The apertures 45 frame the enlargement segment 30.

Bonding devices 55, 56 are also shown diagrammatically. The (partially shown) bonding device 55 is hot glue, which can be applied over all of the edge segments of the holding part 40. The (partially shown) bonding device 56 is adhesive tape, which can be applied over the entire surface of the holding part 40 facing away from the wall element 14.

Figure 7:
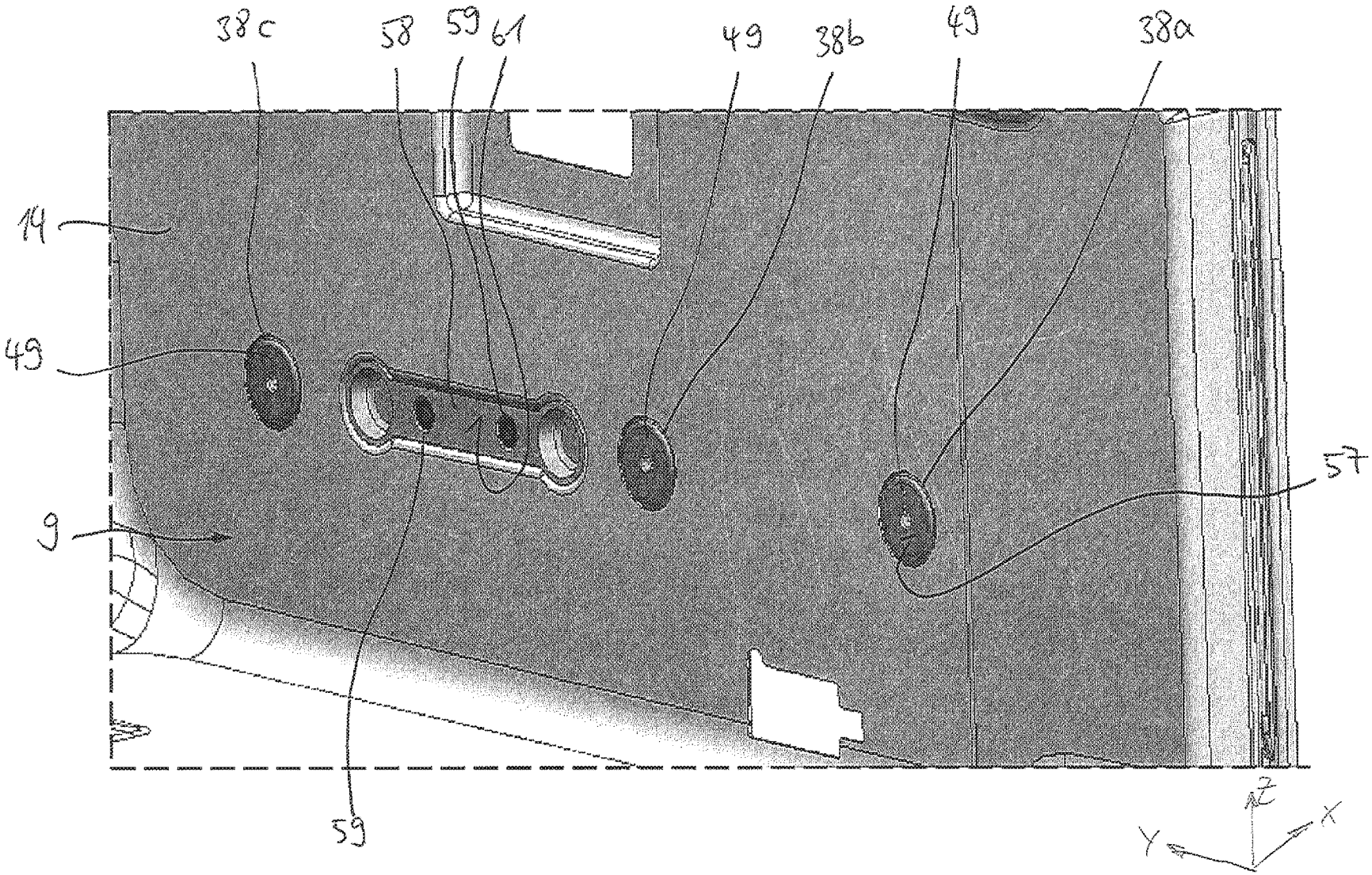
FIG. 7 is a fragmentary, perspective view as in FIG. 3 with the holding part and a fixing element mounted.

As is shown in FIG. 7, the fastening segments 49 engage in the apertures 38*a*, 38*b*, 38*c*. Surfaces 57 of the fastening segments 49 do not project into the receiving chamber 9 in this case. Instead, the surfaces 57 are substantially flush with a surface of the wall element 14 framing the apertures 38*a*, 38*b*, 38*c*.

Figure 8:
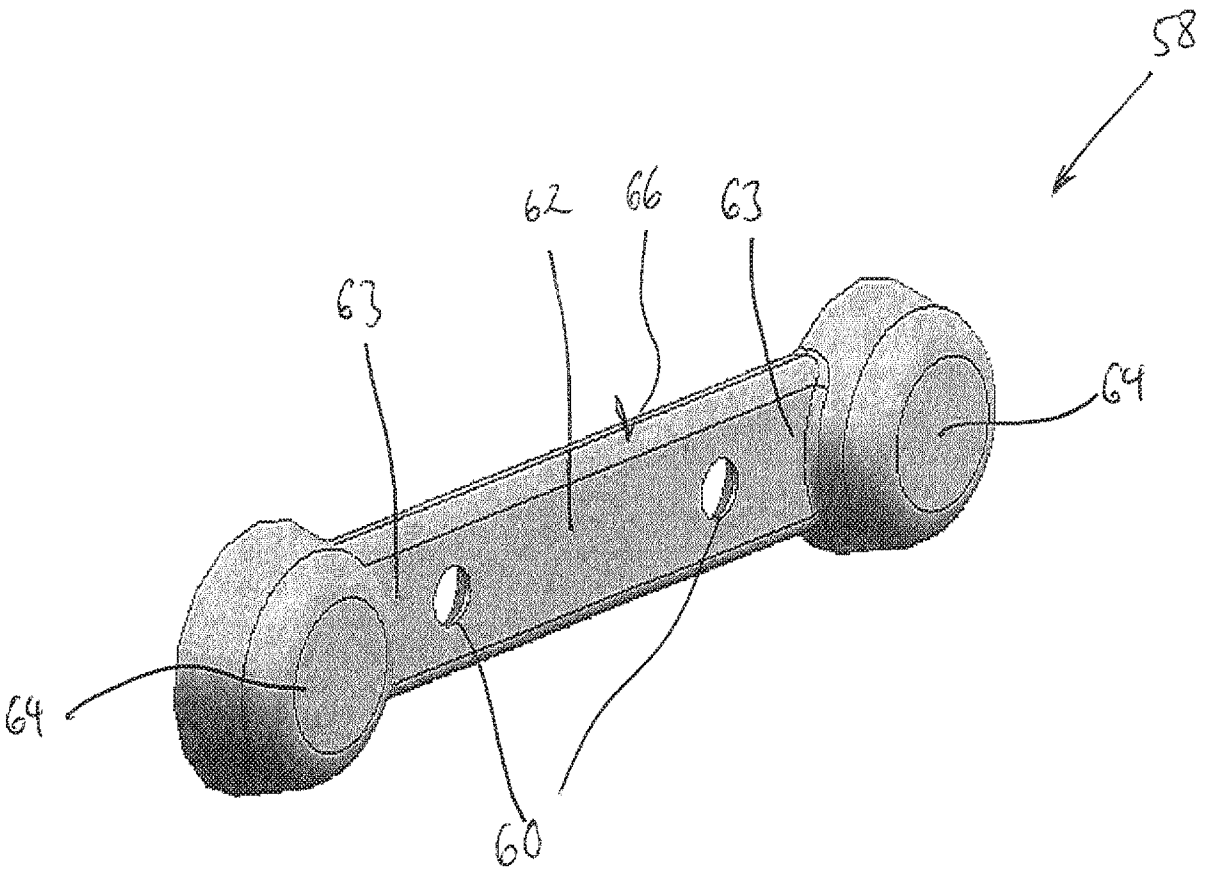
FIG. 8 is a perspective view of the fixing element.

A fixing element 58 (see also FIG. 8) is disposed in the recess 23. The fixing element 58 is connected to the holding part 40 by using two screws 59, which penetrate the apertures 31. The fixing element 58 has two through holes 60 for this purpose.

A surface 61 of the fixing element 58, which is manufactured as a single-piece injection molded plastic part, does not project into the receiving chamber 9 in this case. Instead, the surface 61 is set back in the width direction X relative to the receiving chamber 9.

The fixing element 58 includes a rib-like center piece 62 and two dish-type extension pieces 64 formed on its end segments 63. In the mounted state the fixing element 58 fills the recess 23 substantially completely. Provided on the center piece 62 is a support surface 66, by using which the fixing element 58 can be supported on the bearing surface 34.

The following is a summary list of reference numerals and the corresponding structure used in the above description of the invention.

LIST OF REFERENCE CHARACTERS

1 Household appliance
2 Body
3 Receiving chamber
4 Keep-fresh compartment
5 Door
6 Door
7 Door
8 Receiving chamber
9 Receiving chamber
10 Door
11 Door
12 Drawer
13 Wall element
**13*a*** Inner face
**13*b*** Outer face
14 Wall element
**14*a*** Inner face
15 Pull-out apparatus
16 Container
17 Holding part
18 Outer wall
19 Inner container
20 Built-in part
21 Alignment contour
22 Projection
23 Recess
24 Lengthwise extension

25 Widthwise extension
26 Height extension
27 Rib-like segment
28 Longitudinal extension
29 End segment
30 Enlargement segment
31 Aperture
32 Height extension
33 Bearing surface
34 Bearing surface
35 Boundary wall
36 Bearing surface
37 Bearing surface
38*a* Aperture
38*b* Aperture
38*c* Aperture
39 Wall element
40 Holding part
41 Longitudinal extension
42 Coupling segment
43 Bridge element
44 End segment
45 Aperture
46 Support surface
47 Screw hole
48 Cylindrical indentation
49 Fastening segment
50 Projection
51 Screw hole
52 Cylindrical indentation
53 Rib
54 Base plate
55 Bonding device
56 Bonding device
57 Surface
58 Fixing element
59 Screw
60 Through hole
61 Surface
62 Center piece
63 End segment
64 Extension piece
65 Sub-segment
66 Support surface

The invention claimed is:

1. A household appliance, comprising:

a body;

a receiving chamber disposed in said body;

a wall element at least partially delimiting said receiving chamber, said wall element having a face facing away from said receiving chamber;

an alignment contour provided on said wall element, said alignment contour having a projection facing away from said receiving chamber and being elongated in a plane encompassing said wall element; and a holding part disposed on said face of said wall element, said holding part being coupled to said alignment contour and said holding part extending beyond said alignment contour in said plane encompassing said wall element.

2. The household appliance according to claim 1, wherein said projection has a horizontal longitudinal extension.

3. The household appliance according to claim 1, wherein said alignment contour has a rib-shaped segment.

4. The household appliance according to claim 3, wherein said rib-shaped segment has end segments and enlargement segments formed on said end segments.

5. The household appliance according to claim 4, wherein:

said enlargement segment has a height measured from said surface of said wall element facing away from said receiving chamber;

said enlargement segment has a width measured perpendicular to said longitudinal extension of said alignment contour;

said rib-shaped segment has a height measured from said surface of said wall element facing away from said receiving chamber;

said rib-shaped segment has a width measured perpendicular to said longitudinal extension of said alignment contour; and at least one of:

said height of said enlargement segment is greater than said height of said rib-shaped segment, or said width of said enlargement segment is greater than said width of said rib-shaped segment.

6. The household appliance according to claim 3, wherein said rib-shaped segment has end segments and enlargement segments formed on said end segments, said enlarged segments defining terminal longitudinal ends of said alignment contour.

7. The household appliance according to claim 1, wherein said holding part has a coupling segment at least one of form-lockingly or force-lockingly coupling said holding part to said alignment contour.

8. The household appliance according to claim 7, wherein said coupling segment has at least one of at least one bridge element or at least one aperture.

9. The household appliance according to claim 1, wherein said holding part is elongated, has a longitudinal extension and has at least two mutually spaced-apart fastening segments along said longitudinal extension, and a built-in part disposed in said receiving chamber is fastened to said fastening segments.

10. The household appliance according to claim 9, wherein said holding part has a coupling segment at least one of form-lockingly or force-lockingly coupling said holding part to said alignment contour, and said coupling segment is disposed between said at least two fastening segments along said longitudinal extension of said holding part.

11. The household appliance according to claim 9, wherein said wall element has at least two apertures, and each of said fastening segments is accessible through a respective one of said apertures.

12. The household appliance according to claim 1, which further comprises a pull-out apparatus having a built-in part disposed in said receiving chamber and fastened to said holding part, said holding part being elongated and disposed horizontally.

13. The household appliance according to claim 1, wherein said alignment contour has a recess facing said receiving chamber, and a fixing element is located in said recess and coupled to said holding part.

14. The household appliance according to claim 1, wherein said alignment contour has a recess facing said receiving chamber, and a fixing element is located in said recess and screwed to said holding part.

15. The household appliance according to claim 1, wherein said holding part and said wall element are screwed to one another.

16. The household appliance according to claim 1, wherein said holding part and said wall element are screwed to one another in a region of said alignment contour.

17. The household appliance according to claim 1, which further comprises a bonding device in contact with said holding part and said wall element.

18. A household appliance, comprising:

a body;

a receiving chamber disposed in said body;

a wall element at least partially delimiting said receiving chamber, said wall element having a face facing away from said receiving chamber;

an alignment contour provided on said wall element, said alignment contour having a projection facing away from said receiving chamber and being elongated in a plane encompassing said wall element; and a holding part disposed on said face of said wall element, said holding part being coupled to said alignment contour and said holding part extending over said alignment contour in said plane encompassing said wall element, said holding part having a coupling segment at least one of form-lockingly or force-lockingly coupling said holding part to said alignment contour, said holding part being elongated and having a lengthwise extension with a sub-segment, and said coupling segment only extends over said sub-segment.

19. A household appliance, comprising:

a body;

a receiving chamber disposed in said body;

a holding element having a base plate with a mounting surface;

a wall element at least partially delimiting said receiving chamber, said wall element having a planar face facing away from said receiving chamber, said mounting surface being mounted against said planar face;

an alignment contour provided on said wall element, said alignment contour having a projection projecting out of said planar face and facing away from said receiving chamber, said alignment contour being elongated in a plane encompassing said wall element; and said holding part being coupled to said alignment contour and said holding part extending over said alignment contour in said plane encompassing said wall element.

20. The household appliance according to claim 19, wherein said projection has a bearing surface that projects from said planar face and extends longitudinally, said holding part has a support surface that engages said bearing surface.

* * * * *